US006367086B1

(12) United States Patent
Woodard

(10) Patent No.: US 6,367,086 B1
(45) Date of Patent: Apr. 9, 2002

(54) GARMENT WITH A LOWER ABDOMINAL SUPPORT AND AN INSERT THEREFOR

(76) Inventor: Judith L. Woodard, 4107 Bayou Black Dr., Houma, LA (US) 70360

( * ) Notice: Subject to any disclaimer, the term of this patent is extended or adjusted under 35 U.S.C. 154(b) by 0 days.

(21) Appl. No.: 09/769,152

(22) Filed: Jan. 24, 2001

(51) Int. Cl.[7] ..... A41D 1/06

(52) U.S. Cl. ..... 2/237; 2/227; 2/236

(58) Field of Search ..... 2/227, 44, 228, 2/45, 236, 237, 238, 51, 95, 220, 221, 211, 859, 394, 400–408, 69, 69.5, 79, 80, 81, 83, 73, 82, 78.1–78.3, 464, 92, 93; 450/96–155

(56) References Cited

U.S. PATENT DOCUMENTS

| | | | | | |
|---|---|---|---|---|---|
| 1,006,800 | A | * | 10/1911 | Schumacher | 2/211 |
| 1,082,486 | A | * | 12/1913 | Basch | 2/237 |
| 1,263,225 | A | * | 4/1918 | Gear | 2/237 |
| 1,301,618 | A | * | 4/1919 | Stradling et al. | 450/155 |
| 1,331,457 | A | * | 2/1920 | Elliott | 2/237 |
| 1,494,767 | A | * | 5/1924 | Biehl | 2/237 |
| 1,529,937 | A | | 3/1925 | Turcotte | |
| 1,902,895 | A | * | 3/1933 | Smith | 2/237 |
| 2,096,914 | A | * | 10/1937 | Myers | 2/237 |
| 2,129,556 | A | | 9/1938 | Bartels | |
| 2,197,584 | A | * | 4/1940 | Latter | 2/237 |
| 2,219,556 | A | * | 10/1940 | Finder | 2/237 |
| 2,970,598 | A | | 2/1961 | Backlar | |
| 3,127,896 | A | | 4/1964 | Puliafico | |
| 3,141,457 | A | * | 7/1964 | Davidson | 2/237 |
| 3,185,158 | A | * | 5/1965 | Gattuso | 2/237 |
| 3,457,926 | A | | 7/1969 | Bacon | |
| 4,920,581 | A | | 5/1990 | Gray | |
| 5,283,910 | A | | 2/1994 | Flint | |
| 5,611,084 | A | * | 3/1997 | Garry et al. | 2/93 |

* cited by examiner

*Primary Examiner*—Gloria M. Hale
(74) *Attorney, Agent, or Firm*—Keaty Professional Law Corporation

(57) ABSTRACT

A garment for supporting lower abdomen of a wearer and a supporting device therefor has a pair of elongated flexible strips adapted for securing along inside side seam of the garment a distance below a waistline of the user. A plurality of eye fasteners are secured along a free edge of each flexible strip. A pair of flexible resilient stretchable panels are provided for detachable securing to the flexible strips and for extending across the lower abdomen of the user. Each support panel has spaced-apart hooks secure along one edge of the panels for engaging with the eye fasteners of the flexible strips. Strips with hook and loop fasteners are secured along opposite edges of each panel for bringing the panels together and attaching them to each other for tightening the lower abdomen of the user.

20 Claims, 2 Drawing Sheets

GARMENT WITH A LOWER ABDOMINAL SUPPORT AND AN INSERT THEREFOR

BACKGROUND OF THE INVENTION

This invention relates to a garment and more particularly, to a garment for the lower part of the human torso, such as jeans, pants, skirts or shorts.

The garment manufacturing industry has tong recognized that some members of the public require garment designs that camouflage or make less noticeable wide hips, protruding bellies or other imperfections that may be causing discomfort to the person. Various examples of garments that support lower abdominal area are disclosed in patents issued in the United States. For instance, U.S. Pat. No. 3,185,158 issued on May 25, 1965 to Gattuso for "Adjustable and Detachable, Lower Abdominal Support for Trousers" discloses a garment adapted for supporting a lower distended abdomen. The garment has an insert with an elasticized wedge which is generally fabricated from a relatively heavy, non-stretching material with stiffening stays to prevent rolling or cupping.

Another example is shown in U.S. Pat. No. 3,457,926 issued on Jul. 29, 1969 to Baco et al. for "Abdomen-Compressor for Trousers." The device of the '926 patent shows a front fastener and an exterior waist portion extending from the fastener along the front and sides of the trousers to the rear thereof Inwardly of the exterior waist portion, the trousers have an outer waistband and an inner waistband, which is surrounded by and extends along the outer waistband. The abdomen-compressor is fixedly secured to the inner waistband at the region of the side of the trousers and extends forwardly from the sides to the area of the torso behind the front fastener.

Some of the other known devices have bulky inserts that have a permanent position inside the garment. If the user is experiencing trouble with a particular area below the waistline, the known devices have no vertical adjustability to provide support in just the right place. It is possible that some users, following surgery, will need support in the lowermost portion of the abdomen, while others experience problems closer to the waist level.

The present invention contemplates elimination of drawbacks associated with the prior art and provision of a garment with a detachable insert for supporting and compressing lower abdomen of the wearer at the lever selected by the user.

SUMMARY OF THE INVENTION

It is, therefore, an object of the present invention to provide a garment with a detachable insert for compressing lower abdomen of the wearer.

It is another object of the present invention to provide a supporting insert for jeans, trousers and other similar articles of clothing that can be removed for cleaning and easily positioned inside the garment.

It is a further object of the present invention to provide a garment that can be easily retrofitted for use with the supporting insert for compressing lower abdomen area.

It is still a further object of the present invention to provide a kit for retrofitting a regular garment to an abdomen-supporting garment in an easy and inexpensive manner.

These and other objects of the present invention are achieved through a provision of a garment that has side seams and a waistline outfitted with a support device that is detachably secured to the garment. The support device has a pair of elongated flexible strips provided with a plurality of spaced-apart eye fasteners secured along one vertical edge of each strip. Each flexible strip is fixedly secured to the garment along an inside side seam of the garment.

The support device also has a pair of flexible resilient stretchable support panels that is detachably securable to the elongated strips. Each support panel has one vertical end along which a plurality of spaced-apart hook fasteners are secured. An opposite vertical end of each support panel is provided with strips of hook and loop fasteners to allow the panels to be brought together and secured, thereby closing the supporting device and covering a lower abdomen of the user.

In a preferred embodiment, the flexible, eye fastener-containing strips are longer than corresponding vertical ends of the support panels to allow the user to adjust position of the supporting device up or down in relation to the waistline. The garment may be a pair of slacks, a pair of jeans, a skirt, a dress, etc. The flexible strips may be attached to the garment by stitching or gluing. A kit for retrofitting a regular garment into an abdomen-supporting garment contains two flexible strips and two supporting panels. Instructions are provided for securing the flexible strips and for adjusting position of the panels.

The supporting device, when incorporated into the garment, is entirely concealed by the front of the garment. At the same time, the supporting device supports the lower abdomen, similar to a girdle, but without the inconvenience or expense of the girdle.

BRIEF DESCRIPTION OF THE DRAWINGS

References will now be made to the drawings, wherein like parts are designated by like numerals, and wherein.

DETAIL DESCRIPTION OF THE PREFERRED EMBODIMENT

Figure 1:
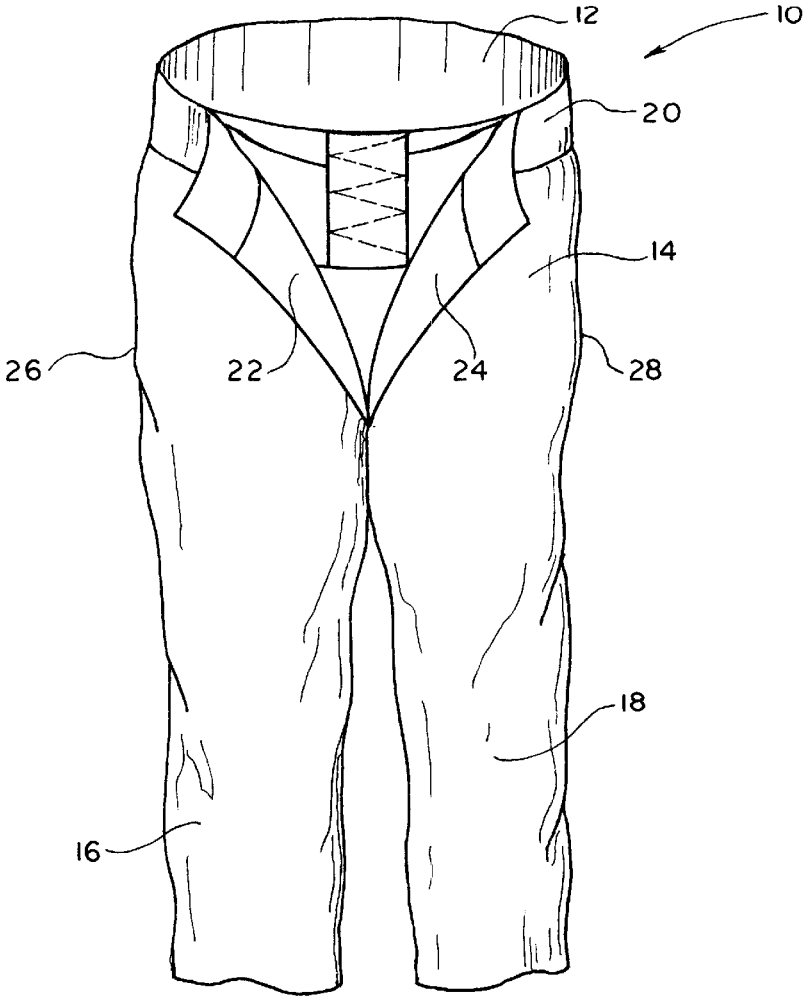
FIG. 1 is a perspective view of the garment of the present invention, with a support insert positioned therein.

Turning now to the drawings in more detail, numeral 10 designates the abdomensupporting garment in accordance with the present invention. Even though the garment 10 is shown in the design of slacks, the supporting member may just as easily be incorporated into pants, trousers, skirts, shorts and other articles of clothing that cover at least a portion of the lower torso of the user below the waistline.

The slacks 10 cover the hips of the user starting with a waistline 12. The garment 10 has an upper portion 14 that encircles the hips and lower abdominal area of the user and leg sections 16 and 18. A waistband 20 is secured to the upper portion 14, starting at approximately the waistline 12 and extending one or one and one half inches below the waistline. Of course, other sizes of the waistband may be present in the garment, such as a narrow waistband or an elastic band.

The front of the garment 10 is provided with a closure (not shown) which may be a zipper or other similar type of closure. The zipper is inserted between opposite flaps 22 and 24 to allow the user to don the garment. The garment 10 has a pair of side seams 26 and 28 that usually extend from the waistline 12 to the lower ends of the leg portions 16 and 18.

Figure 2:
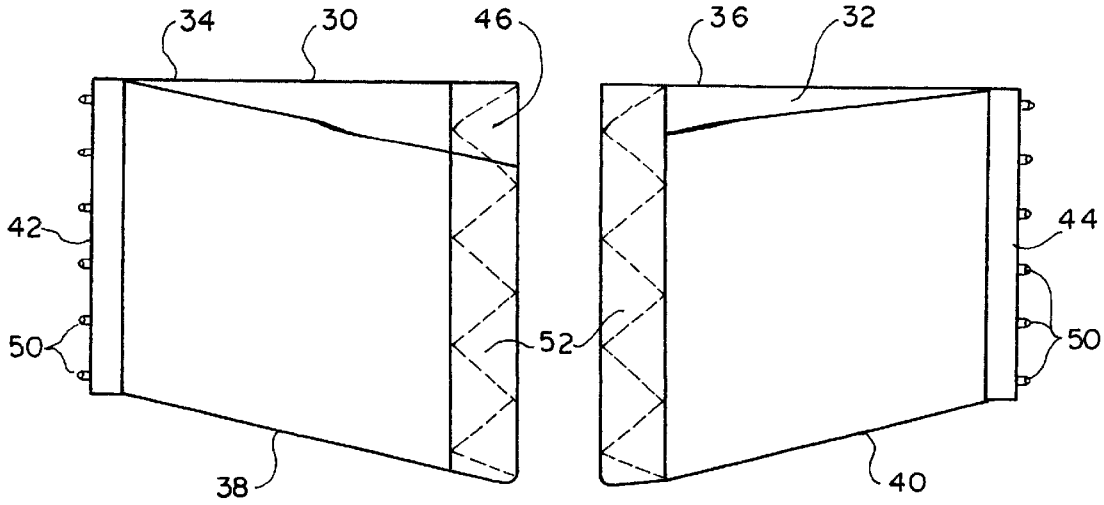
FIG. 2 is a detail view of two panels of the support member.
Figure 3:
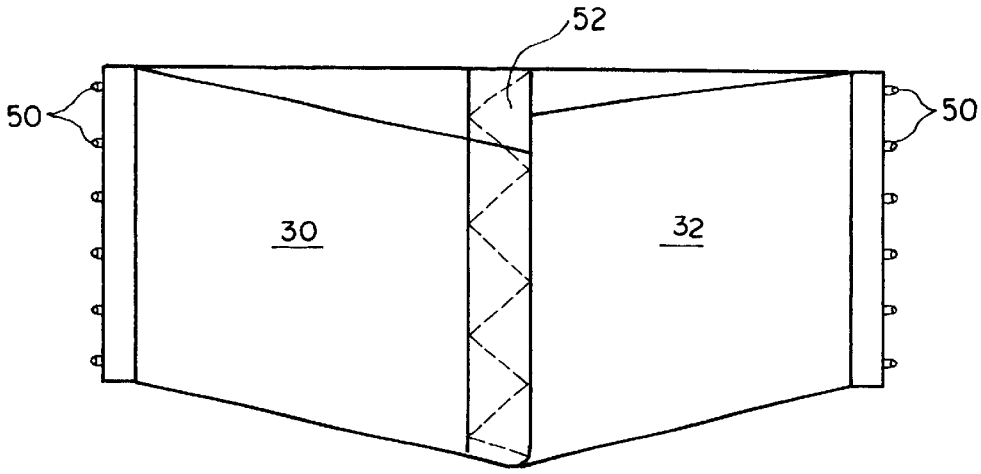
FIG. 3 is a view similar to FIG. 2, with the supporting panels secured together.
Figure 4:
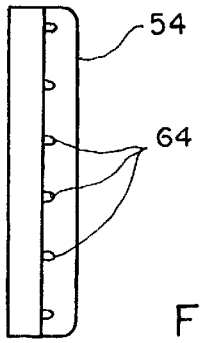
FIG. 4 is a detail view of an eye tape that is used as part of the device of the present invention.

Turning now to FIGS. 2–4, the supporting insert of the present invention is shown in more detail. As can be seen in the drawings, the supporting insert comprises a pair of flexible, resilient, stretchable panels 30, 32 made from, for example, orthopedic elastic. The panels 30 and 32 have sufficient vertical dimension to cover the lower abdominal area of the user and are wide enough to allow mating attachment of the panels 30 and 32 to each other in the center, behind the front closure of the garment 10.

Each panel 30 and 32 has an upper edge 34, 36 respectively, and a lower edge 38 and 40, respectively. Each panel 30, 32 has a first vertical edge 42, 44, respectively and a second vertical edge 46, 48, respectively. Secured along the edges 42 and 44 are a plurality of hook members 50 that extend at equal distances along the edges 42 and 44, substantially along the entire vertical extensions thereof.

Strips of hook and loop fasteners 52 are secured adjacent to the edges 46 and 48. The hook and loop fasteners 52 may be manufactured from Velcro® tape of any desired width, preferably about one inch wide. When the Velcro® strips 52 are secured together, as shown in FIG. 3, the two panels 30 and 32 are brought together and close the insert, forming a continuous lower abdomen-supporting band. If the user desires a more tight support, the user brings the ends of the panels closer together and adjusts the position of the securing area between the hook-and-loop fasteners of the strips 52.

Figure 5:
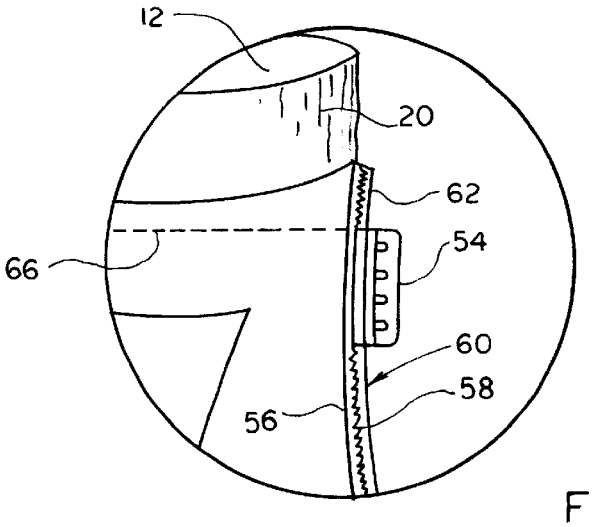
FIG. 5 is a detail view showing positioning of the eye tape along the side seam of a garment.

The supporting device also comprises a means for attaching the panels 30, 32 to the garment per se. The securing means comprises an elongated strip of flexible deformable eye tape 54 secured on the inside of the garment 10. As shown in FIG. 5, when the garment is turned inside out, the inside seams are shown to have a stitch line 56, along which the seam extends, which is spaced, some distance from an outermost edge 60 of the fabric. The extra space 58 formed between the stitch line 56 and the edge 60 serves as a place where the tape 54 may be secured. Conventionally, the edge 60 is finished by a zig zag stitch 62 or other similar means to prevent fraying.

The strip 54 is preferably sewn directly to the extra width of fabric 58 so as to make the eyelet tape 54 fully incorporated into the garment 10. Sometimes the space 58 is very narrow, which makes it impossible to attach the tape 54 by stitching. In that case, it is envisioned that the tape 54 can be stitched directly into the seam 56 with a thread that matches the color of the garment 10. In the alternative, the tape 54 may be secured to the side of the garment by fabric glue.

As shown in FIG. 4, the eye tape 54 is provided with a plurality of eyelets 64. The eyelets 64 are spaced at the same distance as the hooks 50 on the panels 30 and 32. It is preferred that the vertical length of the tape 54 be somewhat greater than the vertical length of the edges 42 and 44, the purpose of which will be described in more detail hereinafter.

The tape 54 is secured to the interior seam of the garment 10 starting at a level 66 which is 2–4 inches below the waistline 12. It is envisioned that the positioning of the tape 54 at a level below the waistline and below the waistband 20 will place the panels 30 and 32 in a strategic location for supporting a lower abdomen of the user. The eyelet tape 54 is fixedly secured inside the garment 10, while the panels 30 and 32 are detachable for cleaning or when the user desires to wear the garment in a more relaxed fashion.

When the supporting insert is to be worn, the user first attaches the panels 30 and 32 by hooking the hooks 50 through the eyelets 64 of the eye tape 54. Depending on where the user experiences more problems, the user may move the panels 30, 32 up or down along the vertical length of the garment 10 by using lower or upper eyelets 64 for securing the panels 30, 32. Since the tape 54 is longer than the vertical edges 42, 44, the user has some flexibility in adjusting position of the supporting insert.

Once the panels 30 and 32 are secured to the garment, the user puts on the garment, and prior to closing the garment along the flaps 22, 24, the user pulls the edges 46 and 48 together and secures them by engaging the hook and loop fasteners of the strips 52. The panels 30, 32, being flexible and stretchable, stretch, to some degree and pull in the lower abdomen of the user, allowing the user to have a slimmer appearance, similar to wearing a girdle. The user then closes the flap portions 22 and 24 in the usual manner, concealing the supporting insert.

It is envisioned that when garments are not provided with a central closure at the front, the supporting insert may be closed prior to either lowering the skirt down or closing the pants or other garments at the side closure. It is also envisioned that for garments made of thin fabric, such as silk pants or wedding dresses, the Velcro® strips 52 may be omitted and other type of closure can be incorporated. Naturally, the color of the supporting panels 30, 32 and other elements of the supporting member can be selected to complement the color of the garment.

Should the user experience any discomfort when bending or walking, especially near the upper portions of the leg, the panels 30, 32 can be moved closer to the waistline 12 to alleviate the problem. It is also envisioned that tall individuals might wish to move the top edge of the eyelet tape 54 more than three inches below the waistline. The elastic panels 30, 32 can be manufactured with different degrees of elasticity and stretchability. For more firm control, less stretchable elastic may be used. For a more relaxed wear, the elastic panels may be made from a more stretchable material. The panels 30, 32 can be easily disengaged from the garment 10 and washed, when required, while the garment 10 may be sent to the cleaners or washed, as appropriate.

The eye strip 54 may be secured by a single straight stitch to the inside portion of the garment 10, so that the eyelets 64 extend towards the front of the garment. The panels 30, 32 may vary in size between two to six inches, depending on the size of the wearer and the desired degree of support. Since all members of the supporting insert are flexible and easily deformable, the user experiences little discomfort in wearing the garment with the supporting insert, similar to what the user might experience wearing a girdle.

If a consumer desires to retrofit a garment to incorporate the support members, a kit may be provided for securing to the garment. The kit consists of two eye strips 54 having a desired length, for example, small, medium and large. The kit also comprises two support panels 30 and 32 having the desired length and stretching ability, such as firm, super firm, etc. The user is provided with detail instructions on how to secure the strips 54 to the garment and with suggested types of securing methods, such as by stitching or by glue. The panels 30, 32 are provided with a corresponding hook-containing tape that is part of the support members to engage the eye strips 54. The panels are also provided with the hook and loop fasteners to allow closing of the panel members for supporting the lower abdomen.

Many other changes and modifications can be made in the design of the present invention without departing from the spirit thereof. I, therefore, pray that my rights to the present invention be limited only by the scope of the appended claims.

I claim:

1. A garment for supporting a lower abdominal area of a user, the garment covering at last a portion of a lower torso of the user, the garment being provided with side seams, comprising:

a pair of elongated flexible strips having a plurality of spaced-apart eye fasteners secured along one vertical edge thereof, said flexible strips being secured along a corresponding side seam of the garment;

a pair of flexible resilient stretchable support panels, each support panel being provided with a plurality of spaced-apart hook fasteners secured along one vertical edge thereof for detachable securing to corresponding eye fasteners of the elongated strips, each of said support panels being further provided with a strip of hook-and-loop fasteners secured along a second vertical edge of each of said support panel for mating engagement with an opposite strip of the hook-and-loop fasteners of another of said pair of support panels.

2. The device of claim 1, wherein each of said flexible strips containing eye fasteners has a vertical dimension greater than the vertical dimension of the corresponding support panel end to allow the user to move the support panels up and down in relation to a waistline of the garment.

3. The device of claim 1, wherein said flexible strips with eye fasteners are secured adjacent the side seams of the garment by stitching.

4. The device of claim 1, wherein said flexible strips with eye fasteners are secured adjacent the side seams of the garment by gluing.

5. The device of claim 1, wherein said garment is provided with a central front closure, and wherein said support panels are detachably secured to each other behind said central closure.

6. The device of claim 1, wherein said support panels are made from an orthopedic elastic.

7. The device of claim 1, wherein said panels are constructed as mirror images of each other.

8. The garment of claim 1, wherein said flexible strips are secured 2–4 inches below a waistline of the user.

9. The garment of claim 1, wherein said garment is a pair of slacks.

10. The garment of claim 1, wherein said garment is a skirt.

11. A garment for supporting a lower abdomen of a user, the garment being provided with side seams and a waistband, comprising:

a pair of elongated flexible strips, each flexible strip having a fist vertical edge and a second vertical edge, a plurality of spaced-apart eye fasteners being secured along the first vertical edge of each flexible strip, said flexible strips being secured along the second vertical edge to a corresponding side seam of the garment;

a pair of flexible resilient stretchable support panels, each support panel having a first vertical end and a second vertical end, a plurality of spaced-apart hook fasteners being secured along the first vertical end of each support panel, a strip of hook-and-loop fasteners being secured along the second vertical end of each of said support panels for detachable securing to corresponding eye fasteners of the elongated strips, said strips of hook-and-loop fasteners being detachably matingly securable with an opposite strip of the hook-and-loop fasteners of another of said pair of support panels, and wherein the first vertical edge of each flexible strip has a longitudinal dimension greater than a longitudinal dimension of the corresponding first end of the support panel.

12. The device of claim 11, wherein said flexible strips with eye fasteners are secured adjacent the side seams of the garment by stitching.

13. The device of claim 11, wherein said flexible strips with eye fasteners are secured adjacent the side seams of the garment by gluing.

14. The device of claim 11, wherein said garment is provided with a central front closure, and wherein said support panels are detachably secured to each other behind said central closure.

15. The device of claim 11, wherein said support panels are made from an orthopedic elastic.

16. The device of claim 11, wherein said garment is a pair of slacks.

17. The device of claim 11, wherein said garment is a skirt.

18. A device for supporting lower abdomen of a user, comprising:

a pair of elongated flexible strips having a plurality of spaced-apart eye fasteners secured along one vertical edge thereof, said flexible strips being adapted for securing along an inner side seam of a garment;

a pair of flexible resilient stretchable support panels, each support panel being provided with a plurality of spaced-apart hook fasteners secured along one vertical edge thereof for detachable securing to corresponding eye fasteners of the elongated strips, each of said support panels being further provided with a strip of hook-and-loop fasteners secured along a second vertical edge of each of said support panel for mating engagement with an opposite strip of the hook-and-loop fasteners of another of said pair of support panels such that said support panels and said flexible strips are concealed by a garment covering a lower abdomen of a user.

19. The device of claim 18, wherein said strips containing eye fasteners have vertical dimension greater than the vertical dimensions of the corresponding support panel ends to allow the user to move the support panels up and down in relation to a waistline of the garment.

20. The device of claim 18, wherein each of said flexible strips is adapted for a fixed attachment to the garment, and said support panels are detachably securable to the flexible strips.

* * * * *